US005520294A

United States Patent [19]

Hanes

[11] Patent Number: 5,520,294

[45] Date of Patent: May 28, 1996

[54] SUPPORT HOUSING FOR A ROTARY END OF A SLACKLESS DRAWBAR

[75] Inventor: Douglas M. Hanes, Pittsburgh, Pa.

[73] Assignee: McConway & Torley Corporation, Pittsburgh, Pa.

[21] Appl. No.: 201,672

[22] Filed: Feb. 25, 1994

[51] Int. Cl.[6] ..... B61G 9/22

[52] U.S. Cl. ..... 213/75 R; 213/61

[58] Field of Search ..... 213/50, 61, 69, 213/75 R

[56] References Cited

U.S. PATENT DOCUMENTS

| | | | |
|---|---|---|---|
| Re. 33,985 | 7/1992 | Glover | 213/62 R |
| 1,557,060 | 10/1925 | Kadel | 213/67 A |
| 2,241,353 | 5/1941 | Kinne et al. | 213/72 |
| 4,456,133 | 6/1984 | Altherr et al. | 213/75 R |
| 4,531,648 | 7/1985 | Paton | 213/50 |
| 4,555,033 | 11/1985 | Miller | 213/51 |
| 4,580,686 | 4/1986 | Elliott | 213/62 A |
| 4,700,853 | 10/1987 | Altherr et al. | 213/50 |
| 4,700,854 | 10/1987 | Chadwick | 213/62 R |
| 4,846,358 | 7/1989 | Rhen | 213/64 |
| 4,946,052 | 8/1990 | Kaim et al. | 213/75 R |
| 4,966,291 | 10/1990 | Glover | 213/62 R |
| 5,000,330 | 3/1991 | Kiam et al. | 213/62 R |
| 5,035,338 | 7/1991 | Kaufhold et al. | 213/50 |
| 5,080,242 | 1/1992 | Steffen et al. | 213/62 R |
| 5,096,075 | 3/1992 | Glover | 213/61 |

*Primary Examiner*—David M. Mitchell
*Assistant Examiner*—S. Joseph Morano
*Attorney, Agent, or Firm*—James Ray & Associates

[57] ABSTRACT

A support housing for a rotary end of a slackless drawbar adapted to be secured within an end of a center sill of a railroad car having an elongated cavity defined by a pair of side wall portions, a top wall portion and a back wall portion, said cavity being adapted to receive the rotary end portion of a rotary drawbar such that a shank portion of such rotary drawbar extends through an open front of the support housing, said cavity being further adapted to receive a buff load bearing block and a slack adjusting gravity wedge between the back wall portion and the rotary end of the rotary drawbar and having a specially configured surface therein adapted to receive a specially configured draft load bearing insert and a flange to retain the specially configured draft load bearing insert within the cavity and against the spherical draft load bearing surface on the rotary end of the rotary drawbar.

19 Claims, 3 Drawing Sheets

SUPPORT HOUSING FOR A ROTARY END OF A SLACKLESS DRAWBAR

CROSS REFERENCE TO RELATED APPLICATION

The invention claimed in this application is closely related to an application by the same inventor and assigned to the same assignee tilted "A DRAWBAR ASSEMBLY DRAFT LOAD BEARING INSERT" having Ser. No. 08/201,637 and filed concurrently herewith.

FIELD OF THE INVENTION

The present invention relates, in general, to housing support members for retaining rotary drawbar assemblies in the end of a railway car center sill, and more particularly, the present invention relates to an improved housing support member having incorporated therein a replaceable draft load bearing insert member with a concave surface which matingly engages with a convex surface disposed on the rotary end of the drawbar assembly which applies draft loads during in-train action.

BACKGROUND OF THE INVENTION

Prior to the present invention, slackless rotary drawbar assemblies have been in wide spread use in the railroad industry for a number of years to couple one end of a railway car to an adjacent end of another car.

One such housing support member for a slackless rotary drawbar assembly is taught in U.S. Pat. No. 4,966,291 which is assigned to the assignee of the present invention. The disclosure of this patent is incorporated herein by reference thereto. With the arrangement taught in this prior art reference, free and cushioned slack is eliminated from the inner connection between cars. This slack elimination substantially minimizes undesirable longitudinal train action forces as well as the undesirable run in and run out of slack between adjacent cars during reversal of buff and draft train actions. This arrangement further minimizes the generation of large forces due to relative acceleration between the cars thereby reducing detrimental wear and damage to car components and lading. Obviously, reduction of wear and damage to such car components results in reduced maintenance cost and the reduction in damage to lading results in fewer damage claims which must be paid by the rail carrier.

Furthermore, the use of slackless rotary drawbar assemblies as a railcar coupling means has reduced the car weight by approximately 650 pounds. Such reduced car weight is achieved through elimination of the need for standard couplers, yokes, cushioning devices and striker bars. Such reduction in the weight of these cars translates into lower fuel consumption, and therefore, lower operating costs. Additionally, the elimination of various car components further reduces the maintenance cost associated with these components.

The draft load bearing surfaces of the housing support members of these prior art devices have, to the best of applicants' knowledge, always been formed as an integral part of the housing support member. This design results in the entire housing support member being manufactured from relatively expensive material in order to provide adequate wear resistance. Further, when these wear surfaces have been worn sufficiently it requires replacement of the entire housing support member, thus resulting in higher maintenance and equipment cost.

Another prior art housing support member for a slackless rotary drawbar assembly is taught in U.S. Pat. No. 5,000,330, the disclosure of which is also incorporated herein by reference. Even though the housing support member in this rotary drawbar assembly includes both a separate front portion and back portion, it suffers from the same wear problems as the housing support member taught in U.S. Pat. No. 4,966,291 discussed in detail above.

SUMMARY OF THE INVENTION

This invention offers to the art an new and improved support system and a new and improved support housing for a rotary end of a slackless rotary drawbar, adapted to be secured within an end of a center sill of a railroad car which provides a number of advantages as noted below. The new and improved support housing has a generally rectangular body of predetermined length, predetermined width and predetermined height, and includes a pair of generally parallel side wall portions, a top wall portion and a back wall portion at the back end of the body, to define a cavity portion at least partially exposed at the forward end of the body opposite the back wall portion. The cavity portion is adapted to receive the rotary end of a rotary drawbar; i.e., the spherical butt end portion of a rotary drawbar, such that a shank portion of the rotary drawbar extends through the exposed forward end of the body. Accordingly, the cavity portion is provided with a specially configured cavity surface adjacent to the back wall portion which is adapted to receive a buff load bearing block and a slack adjusting gravity wedge between the back wall portion and the spherical, rotary (butt) end of the rotary drawbar. Of particular significance is the fact that a second, specially configured cavity surface is also provided within the cavity adjacent to the exposed forward end of the body which is adapted to receive a specially configured draft load bearing insert of one or more component pieces. A means, such as a flange extending from the side wall and top wall portions, is also provided within the cavity portion adjacent to the specially configured cavity surface for receiving the specially configured draft load bearing insert to maintain its position against the draft load bearing surface on the spherical rotary end portion of the rotary drawbar. Accordingly, any wear imposed on the specially configured draft load bearing insert, will be limited thereto, so that when it is worn to the point of needing replacement, only the insert need be replaced and the housing support member can be reused.

OBJECTS OF THE INVENTION

It is, therefore, one of the primary objects of the present invention to provide an improved housing support member capable of accepting a replaceable, specially configured insert therein to independently carry the draft load bearing wear surface.

Another object of the present invention is to provide an improved housing support member for the rotary end portion of a slackless drawbar assembly which will reduce maintenance cost.

Still another object of the present invention is to provide an improved housing support member for the rotary end portion of a slackless drawbar assembly which can be manufactured from a material which is different and lower in cost than the material used for the insert.

Yet another object of the present invention is to provide an improved housing support member for the rotary end of a slackless drawbar assembly which is relatively easy to assemble.

A still further object of the present invention is to provide an improved housing support member for the rotary end portion of a slackless drawbar assembly which will provide a longer useful life.

An additional object of the present invention is to provide an improved housing support member for the rotary end portion of a slackless drawbar assembly in which all of the wear surfaces are disposed on replaceable components.

In addition to the above-identified objects and advantage of the present invention, various other objects and advantages of such invention will become more readily apparent to those persons who are skilled in the railway coupling art from the following more detailed description of the invention, particularly, when such description is taken in conjunction with the attached drawing figures and with the appended claims.

DESCRIPTION OF A PREFERRED EMBODIMENT OF THE INVENTION

Figure 1:
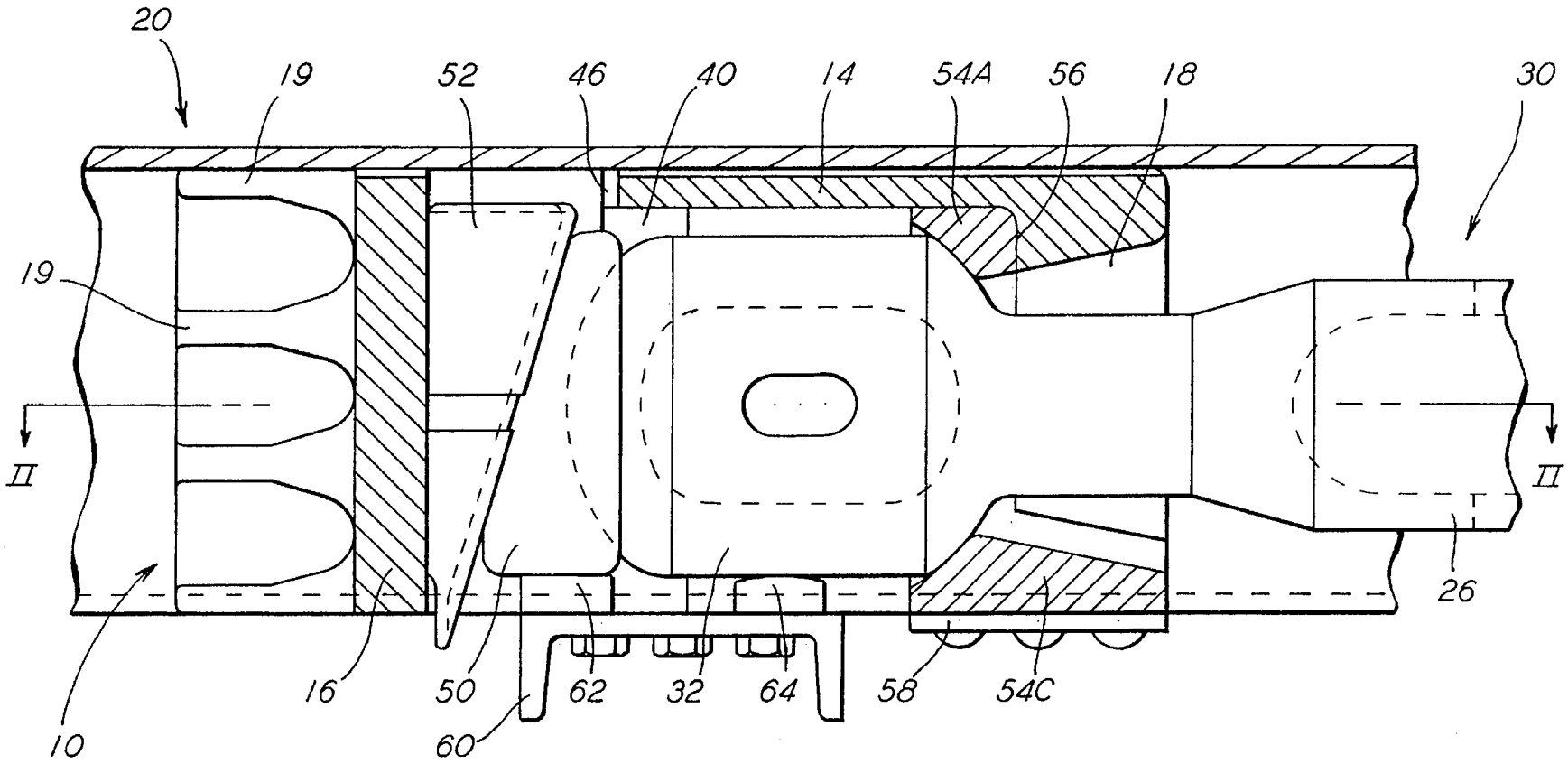
FIG. 1 is an elevation side view partially in cross-section illustrating a housing support member for a rotary end portion of a drawbar assembly according to one embodiment of this invention with the section taken at lines I—I of FIG. 2.

Prior to proceeding with a more detailed description of the invention it should be noted that, for the sake of clarity, identical components having identical functions have been identified with identical reference numerals throughout the several views of the drawings.

Referring more particularly to the attached figures, illustrated therein is a housing support member for a rotary end portion of a rotary drawbar assembly according to one embodiment of this invention generally designated 10, as positioned within an end of a conventional railroad car center sill generally designated 20. A rotary drawbar, generally designated 30, having at least a partially spherical, rotary end portion 32, disposed within the drawbar housing support member 10 is also illustrated. The outer parameters of the housing support member 10 are generally rectangular such that the housing support member 10 will have a predetermined length, a predetermined width and a predetermined height, with dimensions being such as to permit the housing support member 10 to be position within the end of a conventional center sill 20, normally having a pair of vertically disposed, parallel side walls 22 and a horizontally disposed, top wall 24. The housing support member 10 is similarly provided with a pair of generally parallel side wall portions 12 and a top wall portion 14 which, when properly installed within the end of the center sill 20, will position the side wall portions 12 adjacent to the center sill side walls 22 and the top wall 14 adjacent to center sill top wall 24. Normally, the housing support member 10 will be welded into position within the railroad car center sill.

The housing support member 10 is further provided with a cavity portion 40 defined by a back wall portion 16 of housing support member 10, and the above-described pair of side wall portions 12 and top wall portion 14. The cavity portion 40 is intended to contain and support the spherical rotary end portion 32 of a rotary drawbar 30, and the associated components, so that the shank portion 26 of rotary drawbar 30 extends through the open forward end 18 of housing support member 10. While the rotary end portion 32 of drawbar 30 is defined as "spherical", the entire rotary end need not be entirely spherical, but must provide at least a spherical buff load bearing surface on the extreme end, and at least a spherical draft load bearing surface adjacent to the shank portion 26, for purposes of engaging buff and draft load bearing blocks respectively, as will be discussed below, and permitting the spherical rotary end portion 32 to rotate and pivot while confined between the two load bearing blocks.

As in conventional slackless drawbar arrangements, therefore, the spherical rotary end portion 32 of the rotary drawbar 30 engages a rear support block; i.e., a buff load bearing block 50 having a concave, substantially hemispherical surface engaging the substantially hemispherical, convex buff load surface of the spherical rotary end 32 of drawbar 30, with a slack adjusting gravity wedge 52 disposed between the buff load bearing block 50 and back wall portion 16. Accordingly, back wall portion 16 is a solid, vertically disposed wall which functions as a means for transferring buff loads from the buff load bearing block 50, through the gravity wedge 52 to the center sill 20. To function properly, a tapered interface must be provided between the gravity wedge 52 and one of the adjacent members. While FIG. 1 illustrates the tapered interface to be between the gravity wedge 52 and the buff load bearing block 50, such a tapered interface could be provided between the gravity wedge 52 and back wall portion 16.

Figure 2:
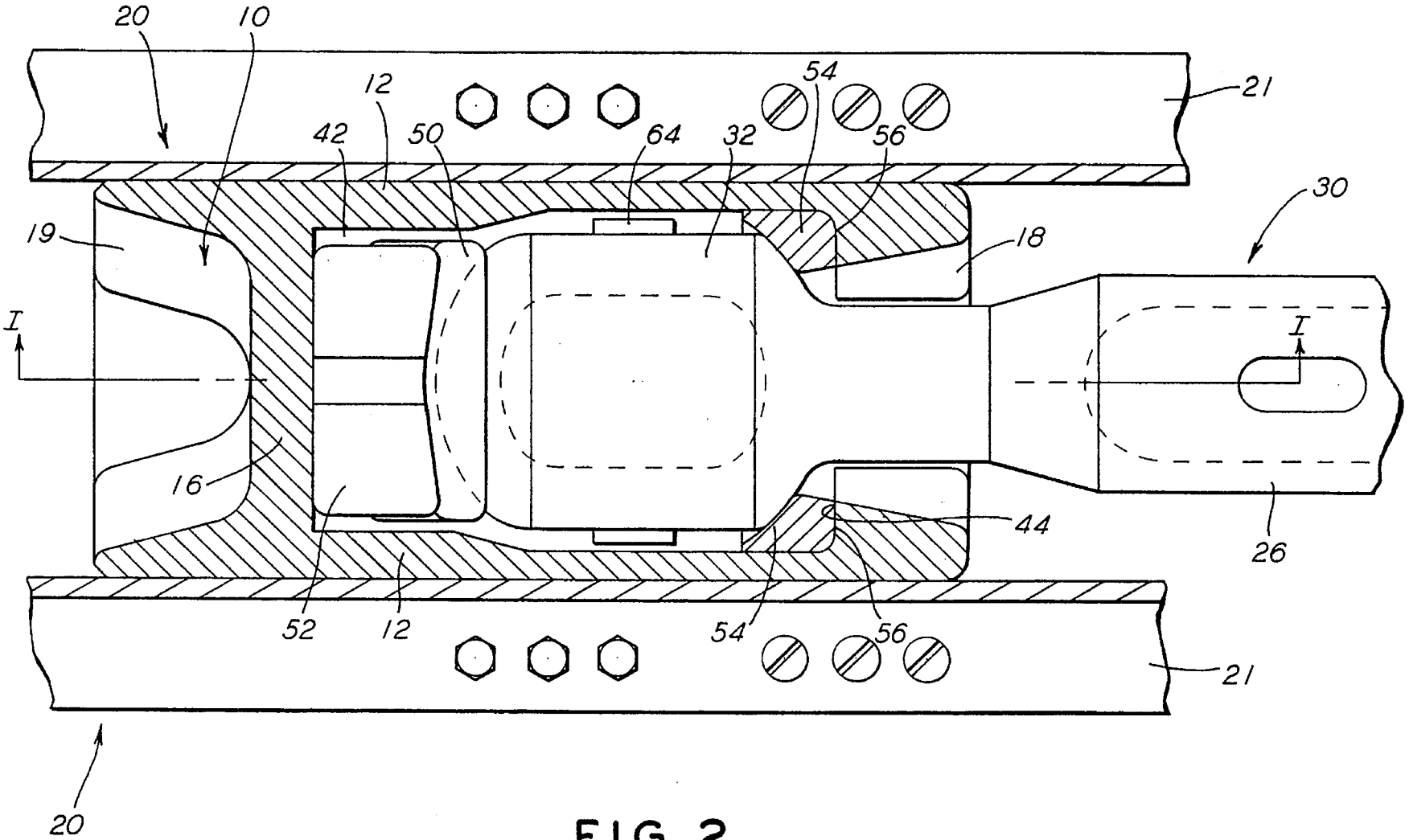
FIG. 2 is a cross-sectional top view of the housing support member illustrated in FIG. 1 with the section taken at lines II—II of FIG. 1.

Accordingly, a specially configured cavity surface 42 within cavity 40, adjacent to back wall portion 16 is provided which is adapted to receive the buff load bearing block 50 and the slack adjusting gravity wedge 52, intermediately between said back wall portion 16 and the spherical rotary end 32 of the rotary drawbar 30. As should be obvious, a means should be provided for transferring buff loads from back wall portion 16 to the center sill 20. As shown in the FIGS. 1 and 2, such a means is provided by a plurality of finger-like wall extensions 19 protruding from back wall portion 16 in a direction away from the cavity 40, and positioned to be adjacent to wall members 22 and 24 of the center sill 20. Accordingly, finger-like, wall, parallel extension members 19 provide a plurality of intersecting edges between the finger-like wall extensions 19 and the walls 22 and 24 of center sill 20 to which weld metal can be applied to thereby literally weld the support housing 10 within the end of the center sill 20. All buff loads will therefore be transferred from the spherical rotary end portion 32 of rotary drawbar 30, to the center sill 20 through buff load bearing block 50, gravity wedge 52, rear wall portion 16, finger-like wall extensions 19 and the weld metal (not shown). As shown in the embodiment illustrated in the drawings, an elongated aperture 46 is provided through top wall portion 14 adjacent to back wall portion 16 for purposes of permitting insertion of the gravity wedge 52. The absence of a lower wall portion on housing support member 10, permits the underside of cavity portion 40 to be open so that the lower end of gravity wedge 52 can extend below the lower edge of housing support member 10 if necessary (as illustrated in FIG. 1).

Figure 3:
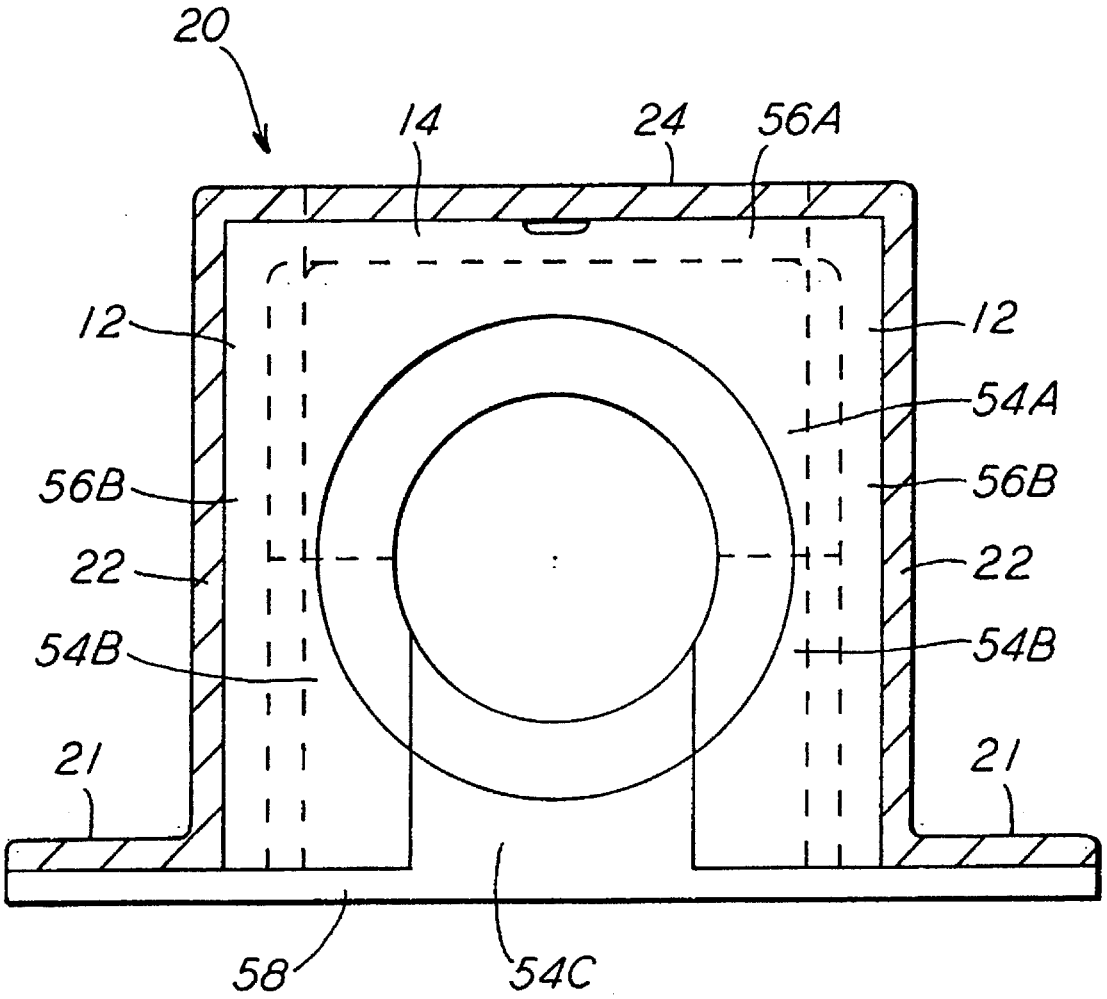
FIG. 3 is an elevational end view of the housing support member illustrated in FIGS. 1 and 2 and showing the specially configured insert components positioned at the front face of the housing support.

One of the advantages of this inventive housing support member 10 is that unlike prior art support housings, draft loads are also transferred from the spherical rotary end portion 32 of rotary drawbar 30 through a replaceable draft load insert 54, such that little or no draft load wear is imposed on the housing support member 10. Accordingly, in addition to the above description with regard to buff loads, another specially configured cavity surface 44 is provided within cavity 40 adjacent to the exposed forward end 18 of housing support member 10, adapted to receive a specially configured draft load bearing insert 54 having one or more component pieces. In the embodiment illustrated in FIG. 3, the specially configured draft load bearing insert 54 comprises four components; namely a top insert component 54A, two side components 54B and a bottom component 54C. When joined together within housing support member 10, the multiple insert components form a front draft block; i.e., a draft load bearing block insert 54 having a concave, substantially hemispherical, draft load bearing surface adapted to engage with the convex draft load bearing surface on spherical rotary end portion 32 of the rotary drawbar 30, while opposed thereto, a specially configured outer periphery is provided which is adapted to engage the specially configured cavity surface 44 within cavity portion 40 intended to receive and contain the draft load bearing insert 54. In addition, a means is also provided within the cavity portion 40 adjacent to the specially configured surface 44 for retaining the specially configured draft load bearing insert 54 within said cavity portion 40 and maintaining it against the spherical rotary end portion 32 of the rotary drawbar 30. As shown in the three figures, such means illustrated comprises an inwardly protruding flange member 56 on each of said side wall portions 12 and said top wall portion 14 which are adapted to support three separate components of said specially configured draft load bearing insert 54, namely the upper component 54A which is supported by the flange member 56A on the top wall portion 14, and the two side components 54B, supported by the flange member 56B on the side wall portions 12. As shown, the lower insert component 54C is secured to cross-bar 58, which is bolted to the lower flanges 21 of center sill 20 such that lower insert component 54C is disposed to extend upwardly between the two side components 54B to complete draft load insert 54. While the four-piece insert 54 as described above is a preferred embodiment, it should be apparent the other embodiments utilizing two, three or more than four component pieces could work equally well.

Independent of the housing support member 10, the system embodiment illustrated in the drawings shows a preferred further inclusion of a dual purpose support means secured to the lower end of center sill 20. Specifically, a support bar 60, which may comprise a short length of channel iron as shown in FIG. 1, is bolted to the lower flanges 21 of center sill 20 and provides a pair of support members on it upper surface which extend upwardly into cavity portion 40. Specifically, one of the support members is a rectangular, base support block 62 provided under the buff load bearing block 50 for purposes of providing a base support for buff load bearing block 50. The other support member is an elongated, generally rectangular base support bar 64 having an elongated, partially cylindrical upper surface provided under the spherical rotary end portion 32 of rotary drawbar 30 to provide a base support for such spherical rotary end portion 32. As can be seen, the axis of the partially cylindrical upper surface of support block 64 is transverse to the axis of the cylindrical portion of spherical rotary end portion 32 of rotary drawbar 30. Support block 62 and support bar 64 serve to support the buff load bearing block 50 and the spherical rotary end portion 32 of rotary drawbar 30, respectively, to maintain their proper level of alignment, and assure concentricity of the spherical rotary end 32 with the buff and draft load bearing blocks 50 and 54 respectively, through periods of transition between buff and draft loading, as well as periods of rotational and pivotal motion of rotational drawbar 30. While base support block 62 must merely serve to maintain the vertical position of the stationary buff load bearing block 50, support bar 64 must maintain the vertical position of the rotary end portion 32 of the drawbar 30 while at the same time allowing it to move rotationally and pivotally. Accordingly, the transverse cylindrical upper surface of support bar 64 must contact and support the rotary end portion 32 of drawbar 30 directly under center or radius of the two spherical, buff and draft load bearing surfaces and itself have a cylindrical radius as will permit three-dimensional pivotal motion of the shank portion 34 of the drawbar 30 without interference.

While a presently preferred embodiment of the present invention has been described in detail above, it should be understood that persons skilled in the art may make various other modifications and adaptations of the invention without departing from the spirit or scope of the appended claims.

I claim:

1. A support housing for a rotary end of a slackless, rotary drawbar adapted to be secured within an end of a center sill of a railroad car comprising; a generally rectangular body having each of a predetermined length, a predetermined width, a predetermined height, said generally rectangular body further having:

(a) a pair of generally parallel side wall portions;

(b) a top wall portion;

(c) a back wall portion at a first end of said body;

(d) a cavity portion disposed intermediate said side wall portions, said top wall portion and said back wall portion, said cavity portion being at least partially exposed at a second end of said body opposite said back wall portion, said cavity portion adapted to receive such rotary end of such rotary drawbar such that a shank portion of such rotary drawbar extends through such at least partially exposed second end of said body;

(e) a first specially configured surface within said cavity adjacent said back wall portion adapted to receive a buff load bearing block and a slack adjusting gravity wedge intermediate said back wall portion and such rotary end of such rotary drawbar;

(f) a second specially configured surface within said cavity adjacent to said at least partially exposed second end of said body, adapted to receive a specially configured draft load bearing insert of one or more component pieces; and (g) means within said cavity portion adjacent to said second specially configured surface for retaining such specially configured draft load bearing insert within said cavity and maintaining it against such rotary end of such rotary drawbar.

2. A support housing for a rotary end of a slackless, rotary drawbar according to claim 1 in which said means within said cavity portion adjacent to said second specially configured surface for retaining such specially configured draft load bearing insert within said cavity comprises an inwardly protruding flange member on each of said side wall portions and said top wall portion.

3. A support housing for a rotary end of a slackless, rotary drawbar according to claim 2 in which said inwardly protruding flange member on each of said side wall portions and said top wall portion are adapted to support three separate components of said specially configured draft load bearing insert, an upper component supported by the flange member on said top wall portion, and two side portions, one each supported by each flange member on said side wall portions.

4. A support housing for a rotary end of a slackless, rotary drawbar according to claim 3 in which said inwardly protruding flange member on each of said side wall portions and said top wall portion comprises a continuous flange having vertical components along each of said side wall portions and a horizontal component along said top wall portion.

5. A support housing for a rotary end of a slackless, rotary drawbar according to claim 4 in which said continuous flange and said second specially configured surface within said cavity to receive said draft load bearing block, together form a surface adapted to hold and retain said draft load bearing insert within said cavity against such rotary end of such rotary drawbar.

6. A support housing for a rotary end of a slackless, rotary drawbar according to claim 1 in which said top wall portion is provided with an elongated aperture through which such gravity wedge is insertable.

7. A support housing for a rotary end of a slackless, rotary drawbar according to claim 1 in which said cavity portion is fully exposed at said second end of said body as necessary to permit unrestricted pivotal motion of such shank portion of such rotary drawbar extending therethrough.

8. A support housing for a rotary end of a slackless, rotary drawbar according to claim 1 further including means associated with said back wall portion for transferring buff loads from said back wall portion to such center sill.

9. A support housing for a rotary end of a slackless, rotary drawbar according to claim 8 in which said means associated with said back wall portion for transferring buff loads from said back wall portion to such center sill comprises a plurality of parallel wall extensions protruding from said back wall portion in a direction away from said cavity, and adapted to be adjacent to wall members of such center sill to provide a plurality of wall extension edges adjacent to such center sill to which weld metal can be applied.

10. A drawbar support system for supporting a rotary end of a slackless, rotary drawbar within a center sill of a railway car comprising:

(a) a support housing for such rotary end of such rotary drawbar adapted to be secured within an end of such center sill of a railroad car comprising; a generally rectangular body having each of a predetermined length, a predetermined width, a predetermined height, said generally rectangular body further having:

(i) a pair of generally parallel side wall portions;

(ii) a top wall portion;

(iii) a back wall portion at a first end of said body;

(iv) a cavity portion disposed intermediate said side wall portions, said top wall portion and said back wall portion, said cavity portion being at least partially exposed at a second end of said body opposite said back wall portion, said cavity portion adapted to receive such rotary end of such rotary drawbar such that a shank portion of such rotary drawbar extends through such at least partially exposed second end of said body;

(v) a first specially configured surface within said cavity adjacent said back wall portion adapted to receive a buff load bearing block and a slack adjusting gravity wedge intermediate said back wall portion and such rotary end of such rotary drawbar;

(vi) a second specially configured surface within said cavity adjacent to said at least partially exposed second end of said body, adapted to receive a specially configured draft load bearing insert of one or more component pieces; and (vii) means within said cavity portion adjacent to said second specially configured surface for retaining such specially configured draft load bearing insert within said cavity and maintaining it against such rotary end of such rotary drawbar;

(b) said buff load bearing block having a concave substantially hemispherical buff load bearing surface adapted to engage with a convex buff load bearing surface of a butt end portion of such rotary drawbar;

(c) said slack adjusting gravity wedge interposed between said buff load bearing block and said back wall portion of said body of said support housing;

(d) said specially configured draft load bearing insert having a concave and substantially hemispherical draft load bearing surface adapted to engage with a convex draft load surface on such rotary end of such rotary drawbar;

(e) means supported by such center sill for transferring draft loads from said support housing to such center sill.

11. A drawbar support system for supporting a rotary end of a slackless, rotary drawbar within a center sill of a railway car according to claim 10 in which said means within said cavity portion adjacent to said second specially configured surface for retaining such specially configured draft load bearing insert within said cavity comprises an inwardly protruding flange member on each of said side wall portions and said top wall portion.

12. A drawbar support system for supporting a rotary end of a slackless, rotary drawbar within a center sill of a railway car according to claim 11 in which said specially configured draft load bearing insert is provided in multiple components including a top component disposed against said flange member on said top wall portion, and a pair of side components disposed against said flange members on said side wall portions.

13. A drawbar support system for supporting a rotary end of a slackless, rotary drawbar within a center sill of a railway car according to claim 12 in which said specially configured draft load bearing insert also includes a bottom component.

14. A drawbar support system for supporting a rotary end of a slackless, rotary drawbar within a center sill of a railway car according to claim 13 in which said bottom component of said specially configured draft load bearing insert is secured to a transverse support member, said transverse support member adapted to be secured to a lower edge of such center sill sufficient to position said bottom component of said specially configured draft load bearing insert in an upwardly extending position between lower ends of said side components.

15. A drawbar support system for supporting a rotary end of a slackless, rotary drawbar within a center sill of a railway car according to claim 10 further including means for supporting said buff load bearing block.

16. A drawbar support system for supporting a rotary end of a slackless, rotary drawbar within a center sill of a railway car according to claim 15 in which said means for supporting said buff load bearing block comprises flat support member adapted to be secured to a lower edge of such center sill and to extend within said cavity directly under said buff load bearing block.

17. A drawbar support system for supporting a rotary end of a slackless, rotary drawbar within a center sill of a railway car according to claim 10 further including means for supporting such rotary end of such rotary drawbar at a proper level of alignment.

18. A drawbar support system for supporting a rotary end of a slackless, rotary drawbar within a center sill of a railway car according to claim 17 in which said means for supporting such rotary end of such rotary drawbar comprises a rotary end support member adapted to be secured to a lower edge of such center sill and to extend within said cavity directly under such rotary end of such rotary drawbar.

19. A drawbar support system for supporting a rotary end of a slackless, rotary drawbar within a center sill of a railway car according to claim 18 in which said rotary end support member comprises a horizontally disposed, elongated support bar having a convex upper surface adapted to engage a lower surface of such rotary end portion of such rotary drawbar.

* * * * *

UNITED STATES PATENT AND TRADEMARK OFFICE

CERTIFICATE OF CORRECTION

PATENT NO. : 5,520,294

DATED : May 28, 1996

INVENTOR(S) : Douglas M. Hanes

It is certified that error appears in the above-indentified patent and that said Letters Patent is hereby corrected as shown below:

Column 4, line 46, please delete "wall, parallel", and insert -- parallel wall --.

Signed and Sealed this

Sixth Day of January, 1998

*Attest:*

Bruce Lehman

BRUCE LEHMAN

*Attesting Officer*

*Commissioner of Patents and Trademarks*